United States Patent [19]

Ganter et al.

[11] Patent Number: 4,666,313

[45] Date of Patent: May 19, 1987

[54] TIMEPIECE AND DRIVE UNIT THEREFOR

[75] Inventors: Wolfgang Ganter, Schramberg; Oskar Flaig, Schramberg-Sulgen; Heinrich Oertel, Tennenbronn; Hans Kaiser, Schramberg; Ewald Kussmaul, Hornberg; Hermann Brede, Schiltach, all of Fed. Rep. of Germany

[73] Assignee: Junghans Uhren GmbH, Schramberg, Fed. Rep. of Germany

[21] Appl. No.: 846,806

[22] Filed: Apr. 1, 1986

[30] Foreign Application Priority Data

Apr. 11, 1985 [DE] Fed. Rep. of Germany ... 8510652[U]
Aug. 6, 1985 [DE] Fed. Rep. of Germany ... 8522587[U]

[51] Int. Cl.[4] ..... G04B 1/00
[52] U.S. Cl. ..... 368/205; 368/276
[58] Field of Search ..... 368/203–205, 368/276, 88, 297–300, 314

[56] References Cited

U.S. PATENT DOCUMENTS

| | | | |
|---|---|---|---|
| 3,427,797 | 2/1969 | Kimura et al. | 368/205 |
| 3,509,712 | 5/1970 | Grohoski | 368/205 |
| 3,890,776 | 6/1975 | Urushida | 368/205 |
| 4,276,629 | 6/1981 | Matsumura et al. | 368/205 |

FOREIGN PATENT DOCUMENTS

| | | | |
|---|---|---|---|
| 58-115390 | 7/1983 | Japan | 368/205 |

*Primary Examiner*—Vit W. Miska
*Attorney, Agent, or Firm*—Burns, Doane, Swecker & Mathis

[57] ABSTRACT

A solar timepiece comprises a drive unit including a commercially available battery clock mechanism mounted to the back of a support plate for the solar cells. The clock mechanism includes hands arbors which pass through an opening in the support plate. The support plate is angularly adjustable about the axis of the hands arbors so that the longitudinal extent of the solar cells can be made to coincide with the decoratively adapted orientation of light passage areas in the dial face located directly in front of it.

5 Claims, 3 Drawing Figures

TIMEPIECE AND DRIVE UNIT THEREFOR

BACKGROUND AND OBJECTS OF THE INVENTION

The invention concerns a solar timepiece and a clock mechanism for such a timepiece.

Within the meaning of the present invention, a solar timepiece is defined as a timepiece with electronic timekeeping which draws its driving energy not from a stationary network or a battery, but by means of an energy storage device from solar cells for the conversion of light energy into electric energy, the solar cells being illuminated at least partially.

With the "Citizen Quartz Cryston Solar Cell" in 1976, a wristwatch appeared on the market wherein the four quadrants of the dial face were occupied by solar cells set into the plane of the dial face within the minute wheel works. As, however, the overwhelming presence of the solar cells in the dial face affected the aesthetic appearance excessively and detrimentally, further development tended to dimension and arrange the solar cells in a manner such that they were displaced as far as possible from the particular design sensitive area of the dial face. Thus, in contemporary solar wrist watches the solar cells are optically integrated in the minute wheel works or hidden under the glass ring of the wrist watch case (with a connection to the environmental illumination by means of specifically designed light conduction devices); or they are entirely removed from the dial face area of the watch and built, for example, into a side wall of the case.

In large timepieces there is sufficient space available outside the minute wheel works to be able to arrange the solar cells without difficulty outside the dial face.

It is an object of the invention to provide a solar timepiece and a clock mechanism for a solar timepiece, preferably in the form of a desk or wall clock, characterized by a convenient mutual layout of the solar cells and the clock mechanism itself, with favorable manufacturing conditions and stylistically attractive design possibilities.

SUMMARY OF THE INVENTION

In contrast to the design trend outlined above, this object is attained according to the invention by means of a solar timepiece comprising a dial face, hands arbors for carrying hands, a support plate through which the hands arbors extend, and a plurality of solar cells mounted on a front face of the support plate immediately adjacent the hands arbors.

Another aspect of the present invention involves a drive unit for use with a solar timepiece of the type having a dial face. The drive unit comprises hands arbors, a clock mechanism for driving the hands arbors, a support plate having a back side to which a clock mechanism is connected and a front side carrying a plurality of solar cells for energizing the clock mechanism. The hands arbors project through an opening in the support plate.

According to the invention, which favors both use as an efficient timepiece and as a universally applicable clock mechanism, the solar cells are, once again, located in the center of the dial face, into the immediate vicinity of the hands arbors. The solar cells thus are able to become a design characteristic in the geometric center area of the dial face, which area is sufficiently large to far exceed the needs of the solar cells. In particular, the invention makes it possible to create a compact standard drive unit that is capable of operation in itself, without a battery and which need merely be equipped with dial face supports to create timepieces of the most varied design. The solar cells can be connected to an energy storage means in the clock mechanism. The invention makes it possible to apply a standard drive unit, without a battery, in highly variable designs, depending on the ornamentation of the dial face, not only parallel to the horizontal or vertical axis of the dial face, but also in numerous angular positions about the principal axis of the hands arbors.

It is possible, in one embodiment to provide a drive unit which is installed through the dial face from the viewing side. In another embodiment, the drive unit can be installed from the back side so as to be disposed behind the dial face, whereby the solar cells are illuminated through light-transmitting regions of the dial face. This permits an altogether simpler and flatter design of the timepiece. With a circular or polygonal solar cell support plate, standard shields for different orientations of the light incident areas in the dial face itself may be used, simply by rotating the support plate until the solar cells coincide with the orientation of the light incident areas in the dial face in front of it. The support plate is conveniently combined with the clock mechanism into a compact standard drive unit capable of operation in itself, without a battery, which needs to be equipped merely with the shield for the dial face to create timepieces of the most varied design, without the need for providing, during or after this installation, electrical connections between the solar cells, the energy storage means and the electric clock circuit in the clock mechanism. That is, electrical connections between the solar cells, the storage means and the circuits are obtained by providing bus bars on the reverse side of the support plate, which simultaneously serve as a supporting structure for the electric and mechanical joining of connecting wires and as joining elements protruding into the clock mechanism itself.

BRIEF DESCRIPTION OF THE DRAWING

The objects and advantages of the invention will become apparent from the following detailed description of preferred embodiments thereof in connection with the accompanying drawings in which like numerals designate like elements, and in which.

DETAILED DESCRIPTION OF THE PREFERRED EMBODIMENTS OF THE INVENTION

Figure 1:
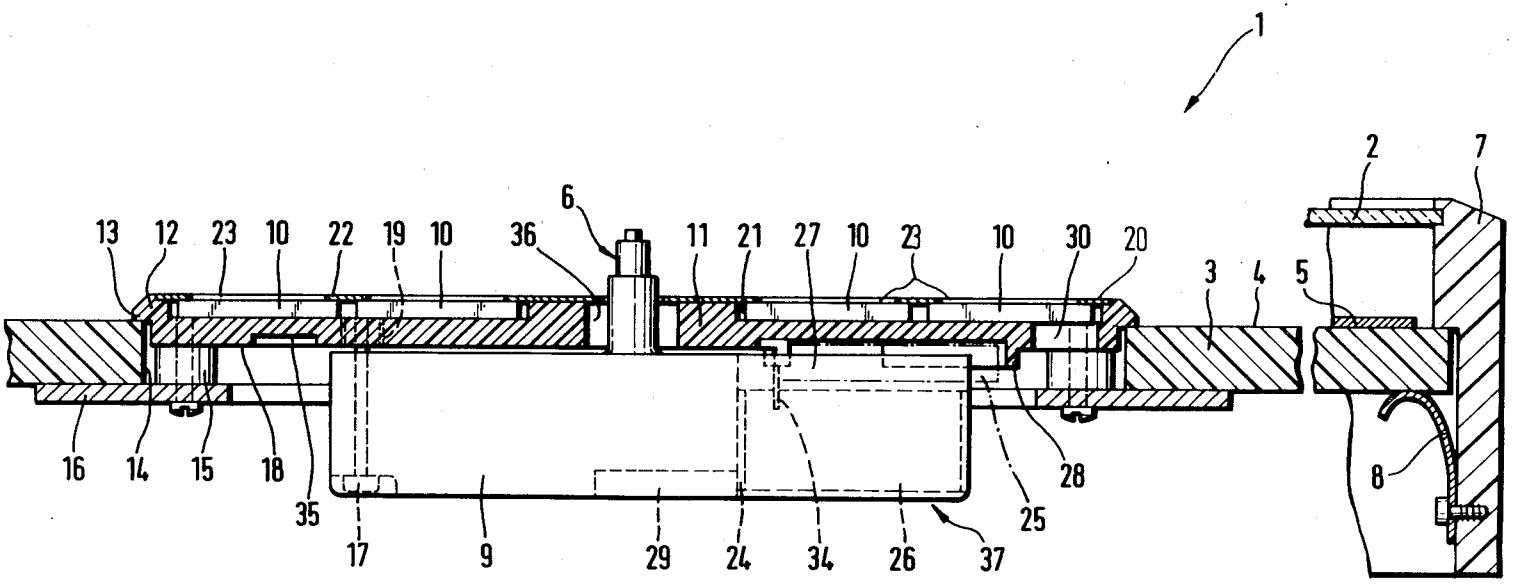
FIG. 1 depicts a solar timepiece in cross-section along with the hands arbor axis with a conventional commercial mechanism, equipped with a solar drive unit comprising a support plate for solar cells, in broken view.
Figure 2:
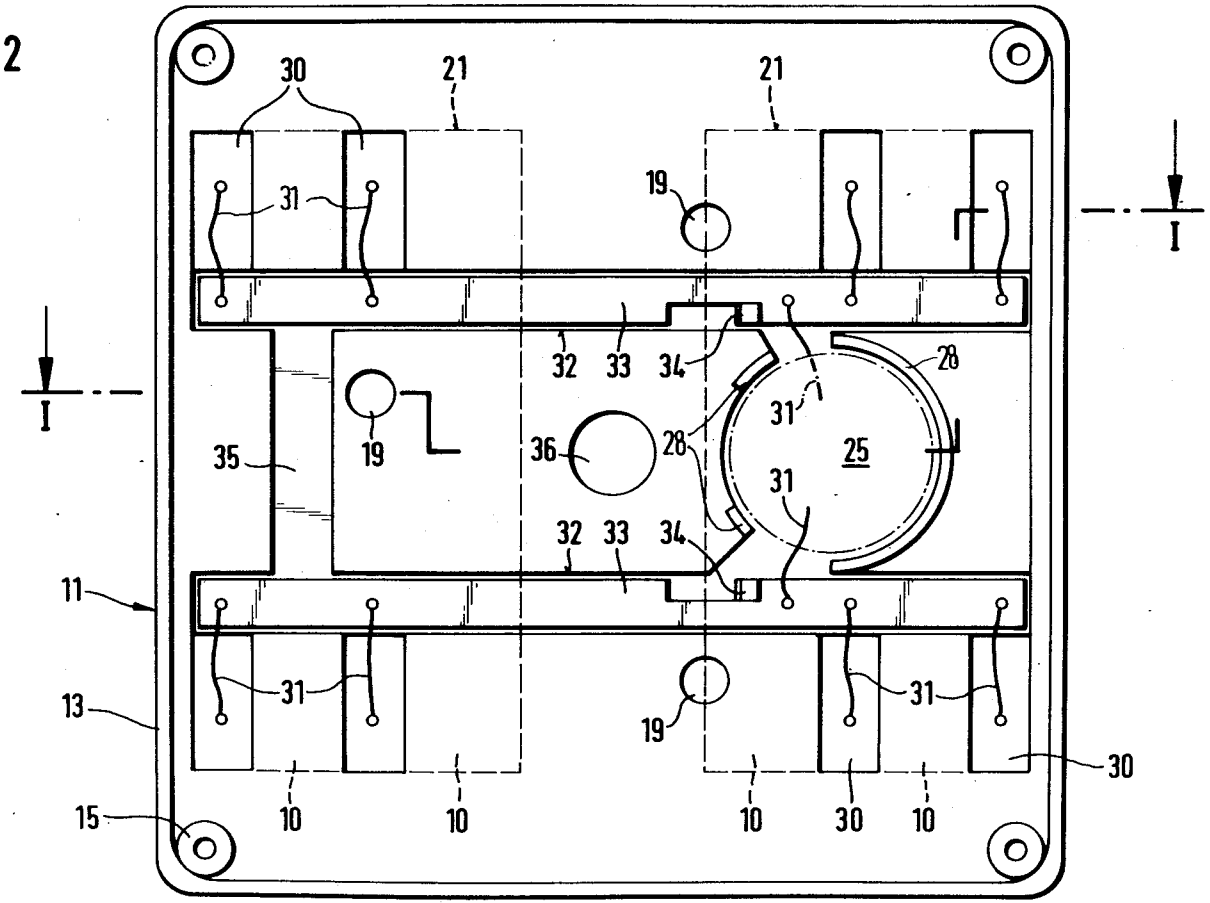
FIG. 2 depicts the support plate according to FIG. 1 in a rear view, prior to the mounting of the clock mechanism.

A solar timepiece 1 according to FIG. 1 comprises a housing including watch crystal 2, and a shield 3 located behind the crystal and serving as the support for a dial face 4 which carries raised minutes indicia 5. The hands (not shown) are rotating in front of the dial and are held and moved by hands arbors 6. The watch crystal 2 is held in a frame 7 into which the shield 3 is set from the reverse side and is secured, for example, by clamps 8. In the embodiment shown, the frame 7 is that of a wall clock open to the rear. Alternatively, in the case of a desk clock, for example an alarm clock, the frame 7 would usually be closed-off by a rear wall, through which the setting means are optionally accessible on the clock mechanism 9.

The electrical energy for the operation of the clock mechanism 9 is obtained by the environmental radiation of natural or artificial light sources incident on the solar cells 10, which are located approximately coplanar with the dial face 4 in the vicinity of the dial face and slightly spaced inwardly from it. In the example shown, four strip-shaped solar cells 10 are mounted in pairs on two diametrically opposing sides of the hands arbors 6.

For the mechanical mounting and the electric connection of the solar cells 10, a support plate 11 is provided which can be injection molded from a synthetic plastic material and forming a single drive unit 37 with the clock mechanism. A peripheral area of the plate 11 is offset shoulder-like toward the rear and includes a rim 13 which projects radially past a recess 14 in the shield 3 of the dial face located centrally within the minute indicia 5. A rearwardly narrowing peripheral area 12 of the support plate 11 projects beyond the plane of the dial face 4 into the shield recess 14. If the recess 14 is in the form of a through-bore, as shown, spacer pins 15 are provided behind the support plate 11 to bridge the space behind the area 12 corresponding roughly to the thickness of the shield 3. At least one holding plate 16 is screwed to the spacer pins 15 by means of screws. The plate 16 has the geometry of a circumferential holding ring and axially clamps the shield 3 against the circular rim 13 of the support plate, thereby also holding the frame 7 by means of the shield 3.

The clock mechanism 9 is fastened to the reverse side 18 of the support plate 11. For this purpose, a central flange screw (not shown) surrounding the hands arbors 6 could be provided. However, for aesthetic reasons, in the present embodiment fastening screws 17 are preferred, which screws pass through the periphery of the clock mechanism 9 parallel to the hands axis and engage screw bushes 19 molded, or mounted, onto the reverse side of the support plate 11.

In the viewing or front side 20 of the support plate 11, recesses 21 are provided to receive the solar cells 10. To compensate for mounting tolerances or to conform with the ornamental appearance of the frame 7, a foil-shaped cover plate 22 is disposed over the plate 11 and includes cut out or transparent areas 23 to expose the solar cells to the incidence of light.

The clock mechanism is designed preferably in the form of a conventional large battery clock mechanism. That is, it is provided in its peripheral area with a chamber 24 adapted to receive a battery. However, since the clock mechanism is powered not by a battery but by electrical power obtained from the solar cells 10, the space of the chamber 24 is available to house an electrical energy storage means 25 and a supplemental circuit 26 (explained in detail below). The electric storage means 25 are located in order to obtain trouble-free wiring connections to the solar cells 10. Preferably, the storage means is located directly behind the cells, i.e., on the rear or side 18 of the support plate 11. In the interest of reduced axial space requirements and secure fastening, a depression 27 is provided in the reverse side 18 of the support plate 11 to receive the storage means 25. A holding wall 28 with openings for the passage of connecting wires 31 surrounds the depression 27.

The solar cells 10 preferably comprise commercially available amorphous semi-conductor cells. The energy storage means 25 preferably comprises a capacitor such as the "gold capacitor" marketed by Matsushita ("Markt und Technik" No. 1/83, pg. 78). If a type of energy storage means is chosen having a nominal voltage corresponding to the maximum expected output voltage of the solar cells 10, it is unnecessary to precede the energy storage 25 with a voltage limiting circuit as is customary in solar operated devices, thereby saving space and obtaining the additional advantage that the energy storage capacity of the storage means 25 (which is proportional to the square of the storage voltage) may be utilized in an optimum manner. There exists, however, the disadvantage that the storage voltage in the case of commercially available solar cells 10 is higher than the operating voltage when supplying the clock mechanism from a single cell primary battery, with the consequence that the operation of the step motor by means of an electronic clock mechanism with over-voltage does not provide optimum conditions in relation to the torque available at the hands arbors 6. In order to compensate for this disadvantage, it is possible to arrange the supplemental circuit 26 in the space of chamber 24 not occupied by the energy storage means 25, the circuit 26 being located electrically ahead of the clock circuit 29. Preferably, this supplemental circuit 26 is in the form of a known constant current circuit, so that independently of the actuation of the cells 10 and the state of the charge of the energy storage 25, the clock circuit 29 is actuated with a current dimensioned for the production of an optimum torque. This results in long operating periods, even in the case of low recharge conditions of the solar cells 10. The afore-mentioned constant current circuit therefore does not constitute a limiting circuit which is customarily used for high capacities against high shorting currents and the latter may be abolished.

It is, however, appropriate to provide a response threshold circuit operating in accordance with a hysteresis switching behavior, which, in order to assure stationary operating conditions at the time of the actuation of the clock mechanism 9, releases (in spite of the high actuating power needs) the storage charge of the storage means (which at the onset of the operation are still discharged) only when a minimum charge has been attained, as described in detail in German Application No. P 35 24 290.6 filed July 6, 1985, "Small Electric Device Powered by Solar Cells, in Particular a Solar Timepiece". The afore-mentioned auxiliary circuits may be housed without difficulty in the battery chamber of the standard mechanism 9, thereby making possible easy electrical connections.

The supplemental circuit 26 may also be designed as a detector circuit to monitor the motor current during the timekeeping actuation of the step motor of the clock mechanism, so that the actuation will be interrupted whenever the motor current satisfies a certain criterion. Typical examples of this layout are given in German Publication No. DE-AS 29 44 872.

The utilization of the usual battery space for the auxiliary circuit 26 (and optionally for storage means 25 protruding into the chamber 24 through an opening of the case) makes possible the use of a clock mechanism 9, produced in series and equipped with the solar cell support plate 11, to obtain a compact drive unit 37 for a solar timepiece 1 capable of operating for several hours even after a brief or weak illumination of the front 20 of the support plate.

Within the area of the cell-receiving recesses 21, passage openings 30 are provided in the support plate 11, through which connecting wires 31 are led from the solar cells 10 to the reverse side 18 of the support plate. In this location, a plurality of metal strips 33 are set in recesses 32 which are formed in the rear side 18 of the support plate. The recesses extend along the openings 30 and are transversely superimposed over the area of the recesses 21. The metal strips 33 serve as busbars. In each case, connecting wires of one polarity of the solar cells 10 and the energy storage 25 lead to one of the busbars 33. Tabs stamped out at the busbars 33 are bent up to form terminal lugs 34 from the plane of the busbars 33 and thus from the plane of the reverse side 18 of the support plate, so as to protrude into the area of the supplemental circuit 26 into the chamber 24 and serve to supply the step motor electric clock mechanism through the clock circuit 29 and the auxiliary circuit 26.

A connecting groove 35 is provided in the reverse side 18 of the support plate between the busbar recesses 32, to house and secure further electric lines that may be required.

To produce the solar timepiece 1 a commercially available battery clock mechanism 9 is equipped in its (battery) chamber 24 with the auxiliary circuit 26. The support plate 11 is equipped on the front side 20 with the solar cells 10 and on the reverse side 18 with the busbars 33 and the energy storage 25. The connecting wires 31 are soldered or welded to the busbars 33. When the front side of the clock mechanism 9 (with the hands arbors 6 passing through a center opening) is connected with the support plate 11 equipped in the afore-described manner, the terminal lugs 34 protrude through an opening of the case and into the chamber 24. Thus, there is achieved a direct, positive contact with the supplemental circuit 26 and a connection with the clock circuit 29. In this manner, there is provided a small drive unit 37 for the hands of a timepiece 1, already capable of operation and thus of testing, and which works without a battery.

Without requiring additional electric connecting measures, and therefore without the risk of damage to the connection between the solar cells 10 and the clock mechanism 9, such a standard drive unit 37 may then be set ready for operation into the shield 3 of a timepiece 1, equipped with a dial face 4. For an aesthetic covering of the solar cells 10, the foil-like cover plate 22 may be applied to the front side 20 of the support pate (for example, adhesively bonded), the cover plate being adapted to the design of the dial face 4 and/or the clock frame 7.

Figure 3:
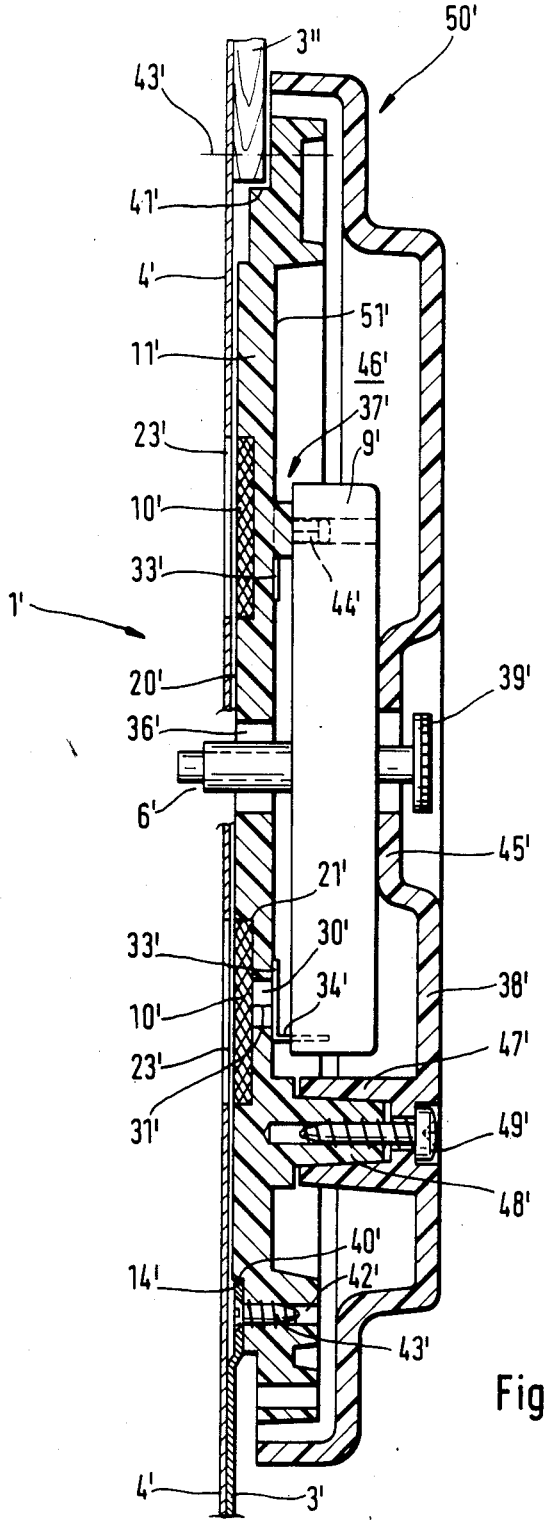
FIG. 3 depicts in broken view, a solar timepiece in axial cross-section along the axis of the hands arbor, with a drive unit in a modified configuration behind a dial face shield.

A modified solar timepiece 1' according to FIG. 3 comprises a thin shield 3', stamped for example from sheet metal, which acts as a support for the dial face 4', in front of which revolve the hands, held and moved by means of arbors 6'. The means for holding the shield 3' in the frame of the case, for example of a wall clock, are not shown.

A setting device 39' for the clock mechanism is accessible at the rear. The setting device projects rearwardly through a cover cap 38' for a drive unit 37' which comprises a clock mechanism 9' and a support plate 11'.

For the mechanical holding and the electrical connection of the solar cells 10', the support plate 11' is provided, which has a flat step 40'' in its front side 20'. The shield 3' includes an offset portion 14' which sits in the step 40'. The support plate 11' may be injected molded from a synthetic plastic. Positioned radially outside the flat step 40' is a deeper step 41' which is formed in the front side 20' of the support plate to receive a heavier shield 3'' made, for example, of wood or a plastic material. The solar cells 10' are positioned in the support plate behind light-transmitting portions 23' (for example, openings) in the dial face 4'. The shield 3' is screwed to the drive unit 37', i.e., to the support plate 11' by means of screws 43' which engage preformed openings 42' in the support plate. The screws are covered on the front side by the dial face 4'' seated on the shield 3' or 3''.

Since the internal periphery 14' of the thin shield 3' is somewhat offset, the screw 43' does not abut rearwardly against the dial face 4'. The drive unit 37' may be mounted in different angular (rotary) positions about the axis of the dial face and therefore is provided preferably with a circular rim or in any case equipped with the circular steps 40', 41', together with a plurality of screw openings 42' offset peripherally with respect to each other. Consequently, the orientation of the strip-shaped solar cells 10' may have numerous angles of inclination in relation to the principal axes of the dial face 4' and therefore make possible a variety of diagonally oriented dial face designs.

The clock mechanism 9' is mounted on the reverse side of the support pate 11', for example by insertion onto multi-cornered, slit holding pegs 44' designed for an outwards clamping action and molded onto the reverse side of the support plate 11' around the opening 36'. Additional clamping of the clock mechanism 9' on the support 11' is provided by a covering cap 38' which includes a recessed center portion 45' that positively abuts the mechanism 9' in the vicinity of the setting device 39'. The cap 38' is connected to the support plate 11' radially outside a chamber 46' which houses the mechanism 9'. The cap 38' includes sockets 47' which frictionally receive pins 48' of the support plate 11'. Screws 49' connect the pins and sockets together. The cap 38' includes a peripheral offset portion 50' which extends radially beyond the sockets 47' to cover the peripheral areas of the support plate 11'. The latter is screwed together with the dial face shield 3' and/or 3''.

The electrical connection between the solar cells 10' and the electric circuit layout and the electromechanical drive unit in the clock mechanism 9' is established by busbars 33', fastened to a rear side 51' of the support plate 11' and engaging by means of beveled terminal lugs 34' the free battery chamber of the clock mechanism 9'. Between the busbars 33' on the rear side 51', a holder (not shown) for the energy storage means, also connected with the busbars 33', may be formed.

Although the present invention has been described in connection with preferred embodiments thereof, it will be appreciated by those skilled in the art that additions, modifications, substitutions, and deletions, not specifically described may be made, without departing from the spirit and scope of the invention as defined in the appended claims.

What we claim is:

1. A solar timepiece comprising:

a housing including a shield and a dial face carried by said shield; and a modular unit attachable as a separate unit to said housing in a plurality of angularly adjusted positions, said modular unit comprising:

a support plate having front and rear sides and an arbor opening passing through said sides, said front side facing said dial face, said support plate being connectible to said shield in different angular positions with reference to an axis defined by said arbor opening, a plurality of solar cells mounted on said front side of said support plate in the vicinity of said arbor opening, an energy storage device mounted on said rear side of said support plate, a plurality of bus bars mounted on said rear side of said support plate and electrically connected to said solar cells by wires extending through said support plate, said bus bars being electrically connected to said energy storage device to transmit charging voltage from said solar cells to said energy storage device, and a clock movement mounted on said rear side of said support plate and including hands arbors passing through said arbor opening.

2. Solar timepiece according to claim 1, wherein a plane defined by said dial face passes through said support plate.

3. Solar timepiece according to claim 1 including a holding plate fastened to a rear side of said support plate and arranged to clamp said dial face against said support plate.

4. A timepiece according to claim 1, wherein support plate includes recess means on its outer periphery for receiving said shield.

5. A timepiece according to claim 1, wherein said clock movement includes a chamber therein, said energy storage device disposed within said chamber.

* * * * *